US006415691B1

(12) United States Patent
Chen

(10) Patent No.: US 6,415,691 B1
(45) Date of Patent: Jul. 9, 2002

(54) RATCHET WRENCH STRUCTURE HAVING A HIGH TORSION DRIVING ACTION ALONG DUAL DIRECTIONS

(76) Inventor: Mu Lin Chen, No. 1, Alley 16, Lane 40, Jinn Te Rd., Taichung (TW)

( * ) Notice: Subject to any disclaimer, the term of this patent is extended or adjusted under 35 U.S.C. 154(b) by 0 days.

(21) Appl. No.: 09/941,209

(22) Filed: Aug. 29, 2001

(51) Int. Cl.[7] ..... B25B 13/46
(52) U.S. Cl. ..... 81/63.2; 81/63
(58) Field of Search ..... 81/60, 61, 62, 81/63, 63.1, 63.2

(56) References Cited

U.S. PATENT DOCUMENTS 3,372,612 A * 3/1968 Rozmus ..... 81/62
3,467,231 A * 9/1969 Haznar ..... 81/62
4,336,728 A * 6/1982 Deibert ..... 81/62

* cited by examiner

*Primary Examiner*—Joseph J. Hail, III
*Assistant Examiner*—Joni B. Danganan

(57) ABSTRACT

A ratchet wrench structure includes a wrench body defining a receiving hole receiving a ratchet wheel and a receiving recess receiving a locking pawl, a resting block, and two elastic members. The locking pawl has a first side formed with locking teeth engaging the engaging teeth of the ratchet wheel, and a second side formed with an arcuate inner face. The resting block has a first end rested on the arcuate resting face of the receiving recess, and a second end formed with a resting end rested on the arcuate inner face of the locking pawl. The two elastic members received in two sides of the resting block, wherein one elastic member is rested on the arcuate resting face of the receiving recess, and the other elastic member is rested on the arcuate inner face of the locking pawl.

5 Claims, 8 Drawing Sheets

RATCHET WRENCH STRUCTURE HAVING A HIGH TORSION DRIVING ACTION ALONG DUAL DIRECTIONS

BACKGROUND OF THE INVENTION

1. Field of the Invention

The present invention relates to a ratchet wrench structure, and more particularly to a ratchet wrench structure having a high torsion driving action along dual directions.

2. Description of the Related Art

The closest prior art of which the applicant is aware is disclosed in U.S. Pat. No. 5,626,062, entitled "SOCKET AND RATCHET WRENCH". However, the locking pawl and the ratchet wheel are engaged with each other by fewer teeth only. Thus, if the torque is too large, the engaging teeth of the locking pawl or the ratchet wheel are easily worn out due to the large torque, so that the ratchet wrench is inoperative.

Other prior arts of which the applicant is aware are disclosed in Taiwanese Patent Publication No. 262785, entitled "DRIVING STRUCTURE OF A HAND TOOL", in the U.S. Pat. No. 5,230,262, entitled "RATCHET WRENCH", and in the Taiwanese Patent Publication No. 386476, entitled by "IMPROVEMENT OF RATCHET WRENCH STRUCTURE". However, when the ratchet wrench is rotated, some teeth of the locking pawl are slightly detached from the engaging teeth of the ratchet wheel, so that the locking pawl is not rigidly and tightly engaged with the ratchet wheel, thereby reducing the entire load bearing torque of the ratchet wrench.

SUMMARY OF THE INVENTION

The present invention has arisen to mitigate and/or obviate the disadvantage of the conventional ratchet wrenches.

The primary objective of the present invention is to provide a ratchet wrench structure which can be assembled easily and quickly.

Another objective of the present invention is to provide a ratchet wrench structure which can operate a workpiece rigidly and stably.

In accordance with the present invention, there is provided a ratchet wrench structure, comprising:

a wrench body having a drive head defining a receiving hole for receiving a ratchet wheel, the receiving hole having one side defining a receiving recess for receiving a locking pawl, a resting block, and two elastic members, the receiving recess formed with an arcuate resting face so that one end of the resting block is rested on the arcuate resting face of the receiving recess;

the ratchet wheel having an outer periphery provided with engaging teeth;

the locking pawl substantially semi-arc-shaped, and having a first side formed with locking teeth capable of engaging the engaging teeth of the ratchet wheel, and a second side formed with an arcuate inner face;

the resting block substantially having an elongated shape, and having a first end rested on the arcuate resting face of the receiving recess, and a second end formed with a resting end rested on the arcuate inner face of the locking pawl; and the two elastic members received in two sides of the resting block, the resting block and the two elastic members being arranged to form a substantially X-shaped combination, so that a first elastic member is rested on the arcuate resting face of the receiving recess, and a second elastic member is rested on the arcuate inner face of the locking pawl.

Further benefits and advantages of the present invention will become apparent after a careful reading of the detailed description with appropriate reference to the accompanying drawings.

DETAILED DESCRIPTION OF THE INVENTION

Figure 1:
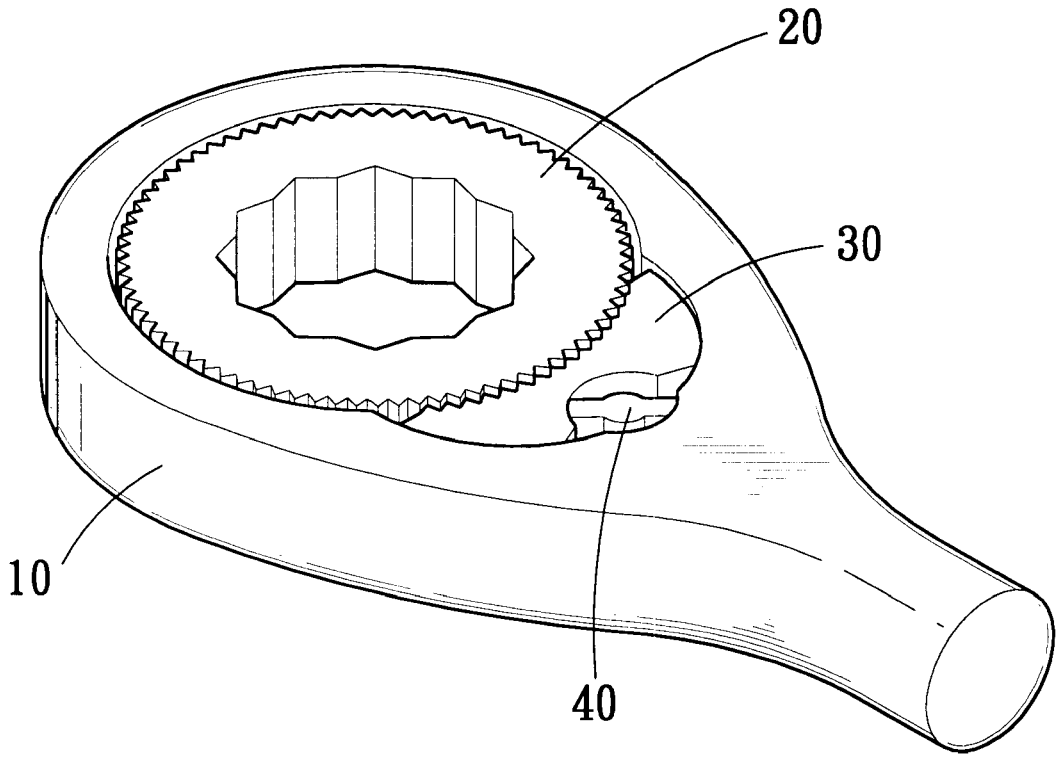
FIG. 1 is a perspective assembly view of a ratchet wrench structure in accordance with a first embodiment of the present invention.
Figure 2:
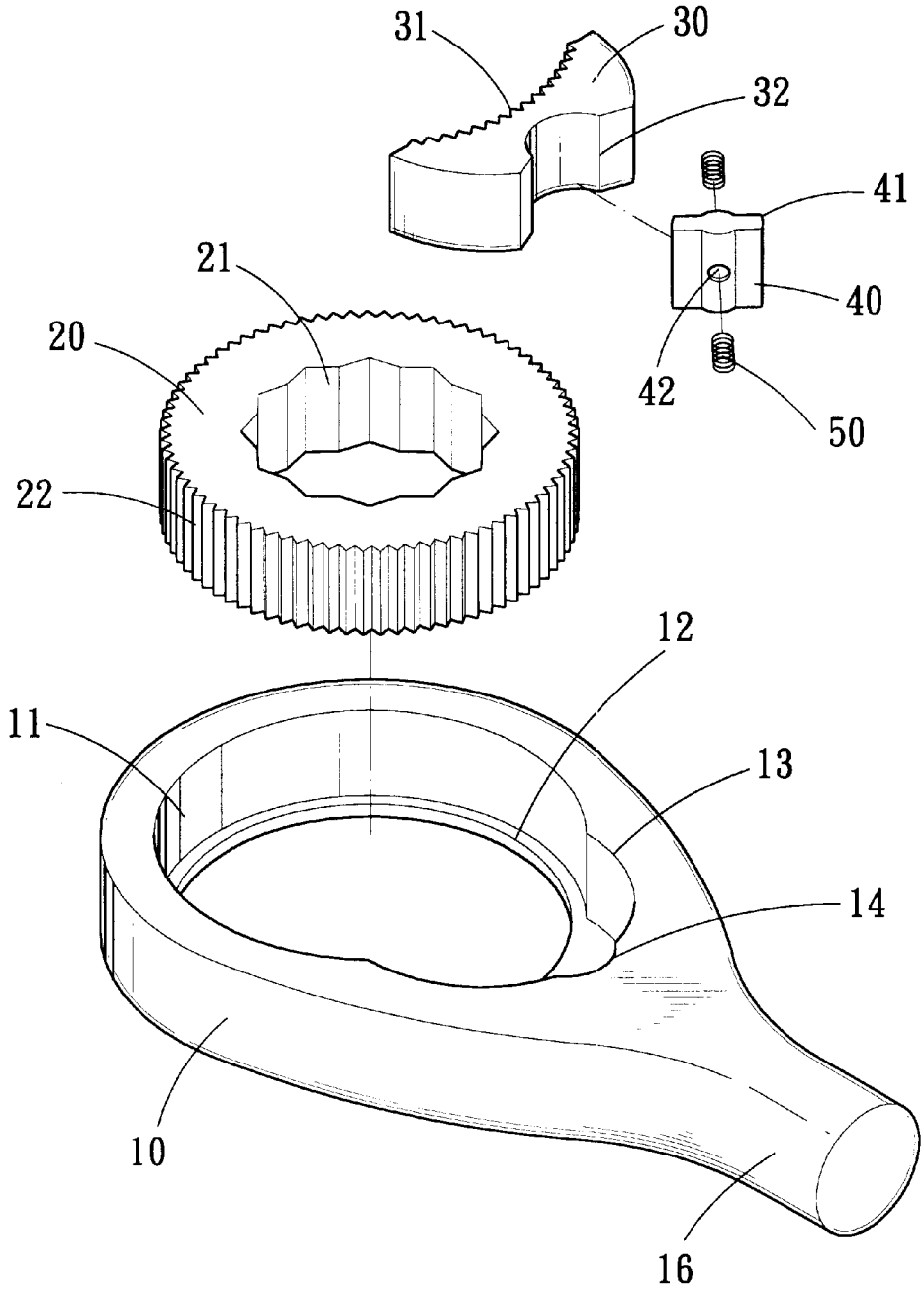
FIG. 2 is an exploded perspective view of the ratchet wrench structure as shown in FIG. 1.
Figure 3:
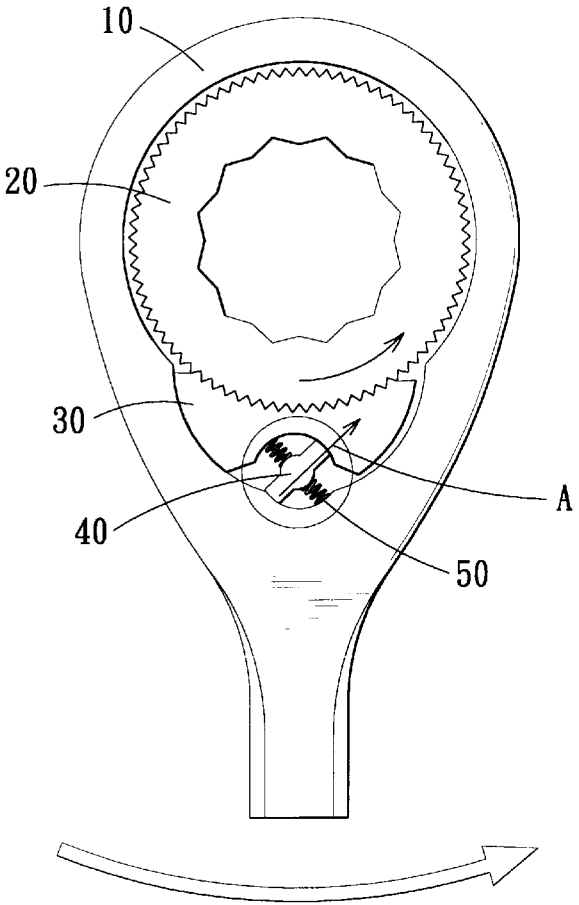
FIG. 3 is a top plan view of the ratchet wrench structure as shown in FIG. 1.

Referring to the drawings and initially to FIGS. 1–3, a ratchet wrench structure in accordance with a first embodiment of the present invention comprises a wrench body having a drive head 10 defining a receiving hole 11 for receiving a ratchet wheel 20. The receiving hole 11 has a bottom end formed with an annular locking flange 12 having a smaller inner diameter. The receiving hole 11 has one side located adjacent to the shank 16 of the wrench body and defining a receiving recess 13 for receiving a locking pawl 30, a resting block 40, and two elastic members 50. The receiving recess 13 is formed with an arcuate resting face 14 so that one end of the resting block 40 may be rested on the arcuate resting face 14 of the receiving recess 13.

The ratchet wheel 20 has an outer periphery provided with multiple engaging teeth 22, and has a center formed with a polygonal recess 21 to mate with a workpiece (not shown).

The locking pawl 30 is substantially semi-arc-shaped, and has a first side formed with locking teeth 31 capable of engaging the engaging teeth 22 of the ratchet wheel 20, and a second side formed with an arcuate inner face 32. The resting end 41 of the resting block 40 may be rested on the arcuate inner face 32 of the locking pawl 30, so that the locking pawl 30 may engage the ratchet wheel 20 rigidly and stably.

The resting block 40 substantially has an elongated shape, and has a first end rested on the arcuate resting face 14 of the receiving recess 13, and a second end formed with a resting end 41 rested on the arcuate inner face 32 of the locking pawl 30. The resting block 40 has two sides formed with two receiving spaces 42 for receiving the two elastic members 50. The resting block 40 and the two elastic members 50 are arranged to form a substantially X-shaped combination, so that one elastic member 50 is rested on the arcuate resting face 14 of the receiving recess 13, and the other elastic member 50 is rested on the arcuate inner face 32 of the locking pawl 30.

After the parts of the ratchet wrench structure in accordance with the present invention have been assembled as shown in FIG. 2, a panel (not shown) may be provided to cover the drive head 10 of the wrench body, thereby preventing the parts contained in the drive head 10 of the wrench body from being detached from the drive head 10 of the wrench body.

Alternatively, the resting block 40 may be integrally formed with the two elastic members 50. Thus, after the ratchet wheel 20 is placed into the receiving hole 11 and the locking pawl 30 is placed into the receiving recess 13, the resting block 40 together with the two elastic members 50 is placed into the receiving recess 13 simultaneously, so that the ratchet wrench structure of the present invention may be assembled easily and quickly.

Figure 3A:
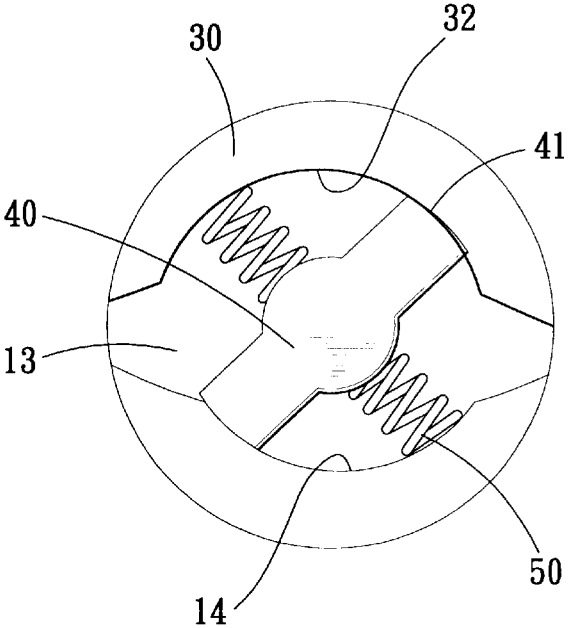
FIG. 3A is a partially enlarged view of the ratchet wrench structure as shown in FIG. 3.

In operation, referring to FIGS. 3 and 3A, the resting block 40 and the two elastic members 50 form a substantially X-shaped combination.

When the resting end 41 of the resting block 40 is rested on the right side of the arcuate inner face 32 of the locking pawl 30 as indicated by arrow "A" in FIG. 3, the other end of the resting block 40 is rested on the left side of the arcuate resting face 14 of the receiving recess 13. At the same time, one elastic member 50 is rested on the left side of the arcuate inner face 32 of the locking pawl 30, while the other elastic member 50 is rested on the right side of the arcuate resting face 14 of the receiving recess 13.

The one elastic member 50 rested on the left side of the arcuate inner face 32 of the locking pawl 30 and the other elastic member 50 rested on the right side of the arcuate resting face 14 of the receiving recess 13 may force the locking pawl 30 to displace to one side face of the receiving recess 13 of the drive head 10 of the wrench body by the elastic force of the elastic members 50, so that the drive head 10 of the wrench body may drive the locking pawl 30 to drive the ratchet wheel 20 to rotate in the counterclockwise direction as shown in FIG. 3.

Figure 4:
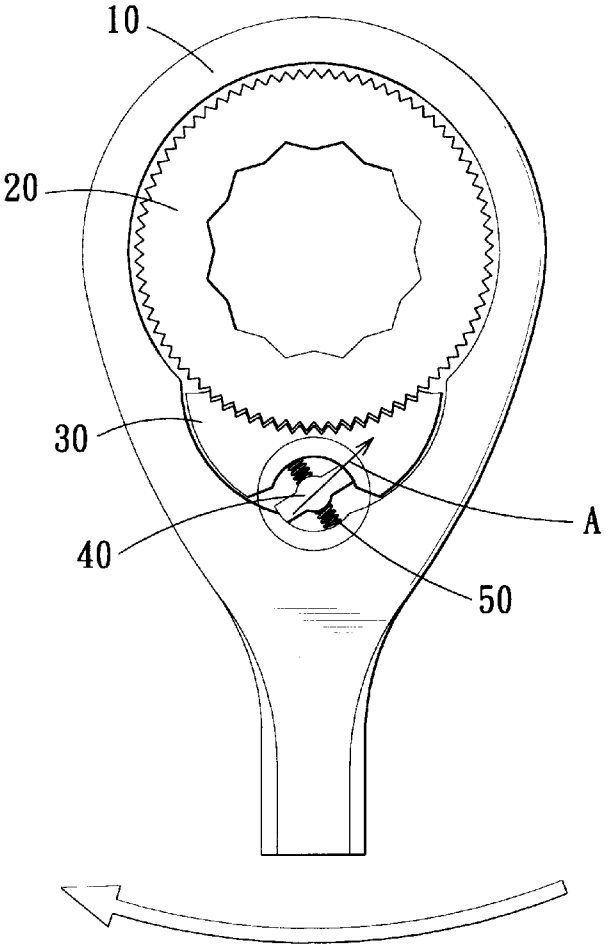
FIG. 4 is a top plan view of the ratchet wrench structure as shown in FIG. 1.
Figure 4A:
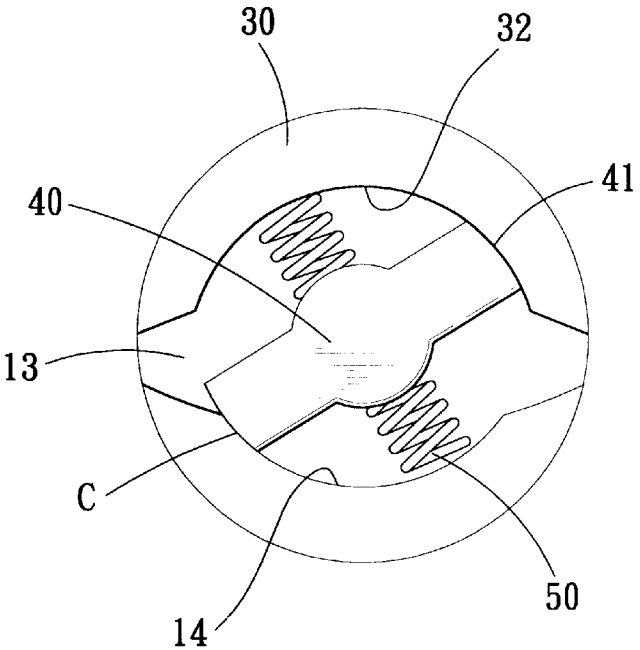
FIG. 4A is a partially enlarged view of the ratchet wrench structure as shown in FIG. 4.

Referring to FIGS. 4 and 4A, the drive head 10 of the wrench body is rotated in the clockwise direction. The ratchet wheel 20 itself is retained by the workpiece (not shown). The other elastic member 50 rested on the right side of the arcuate resting face 14 of the receiving recess 13 may be compressed, so that the drive head 10 of the wrench body cannot drive the locking pawl 30 to drive and rotate the ratchet wheel 20 in the clockwise direction. In such a manner, the ratchet wheel 20 is detached from the locking pawl 30 as shown in FIG. 4, and the resting block 40 is rotated about point "C"(see FIG. 4A) through a small angle. Thus, the drive head 10 of the wrench body may drive the ratchet wheel 20 to rotate in the counterclockwise direction only.

Figure 5:
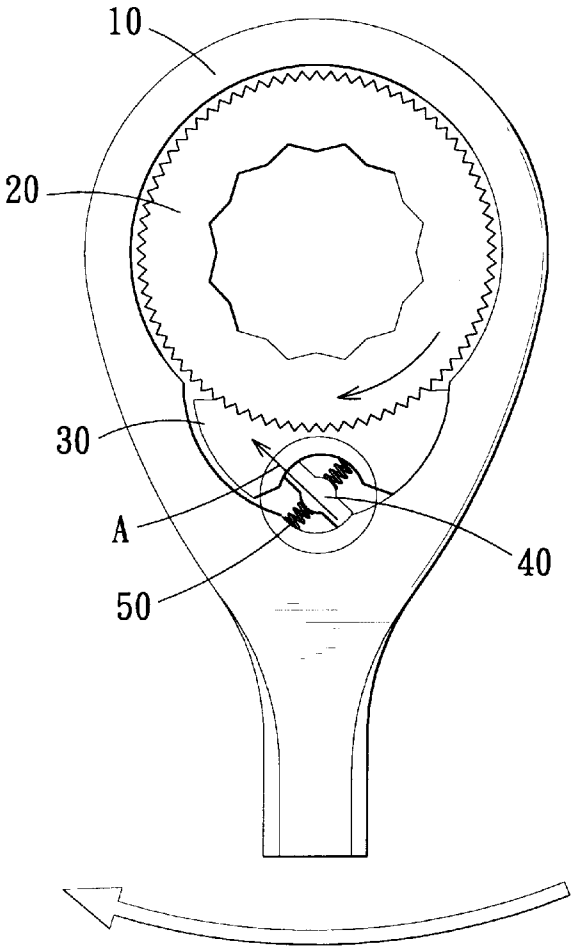
FIG. 5 is a top plan view of the ratchet wrench structure as shown in FIG. 1.
Figure 5A:
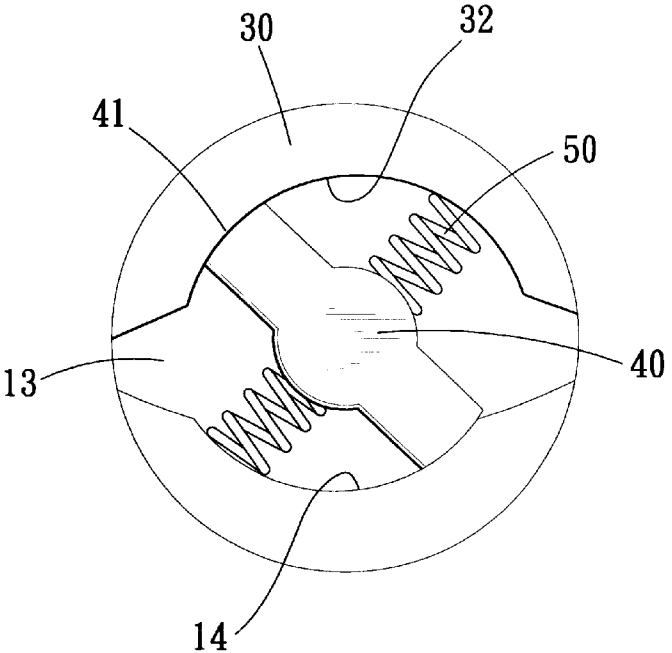
FIG. 5A is a partially enlarged view of the ratchet wrench structure as shown in FIG. 5.

Referring to FIGS. 5 and 5A, the resting end 41 of the resting block 40 is rested on the left side of the arcuate inner face 32 of the locking pawl 30 as indicated by arrow "A" in FIG. 5, while the other end of the resting block 40 is rested on the right side of the arcuate resting face 14 of the receiving recess 13. At the same time, one elastic member 50 is rested on the right side of the arcuate inner face 32 of the locking pawl 30, while the other elastic member 50 is rested on the left side of the arcuate resting face 14 of the receiving recess 13.

The one elastic member 50 rested on the right side of the arcuate inner face 32 of the locking pawl 30 and the other elastic member 50 rested on the left side of the arcuate resting face 14 of the receiving recess 13 may force the locking pawl 30 to displace to the other side face of the receiving recess 13 of the drive head 10 of the wrench body by the elastic force of the elastic members 50, so that the drive head 10 of the wrench body may drive the locking pawl 30 to drive the ratchet wheel 20 to rotate in the clockwise direction as shown in FIG. 5.

Accordingly, the most important advantage of the present invention is described as follows. Referring to FIGS. 3 and 5, when the drive head 10 of the wrench body drives the locking pawl 30 to drive the ratchet wheel 20 to rotate in the counterclockwise or clockwise direction, the resting end 41 of the resting block 40 is urged on the arcuate inner face 32 of the locking pawl 30 as indicated by arrow "A" in FIGS. 3 and 5, while the other end of the resting block 40 is urged on the arcuate resting face 14 of the receiving recess 13, so that the locking teeth 31 of the locking pawl 30 may securely and rigidly engage the engaging teeth 22 of the ratchet wheel 20 without detachment, thereby greatly facilitating the drive head 10 of the wrench body driving the locking pawl 30 to drive the ratchet wheel 20 to operate and rotate the workpiece.

Figure 6:
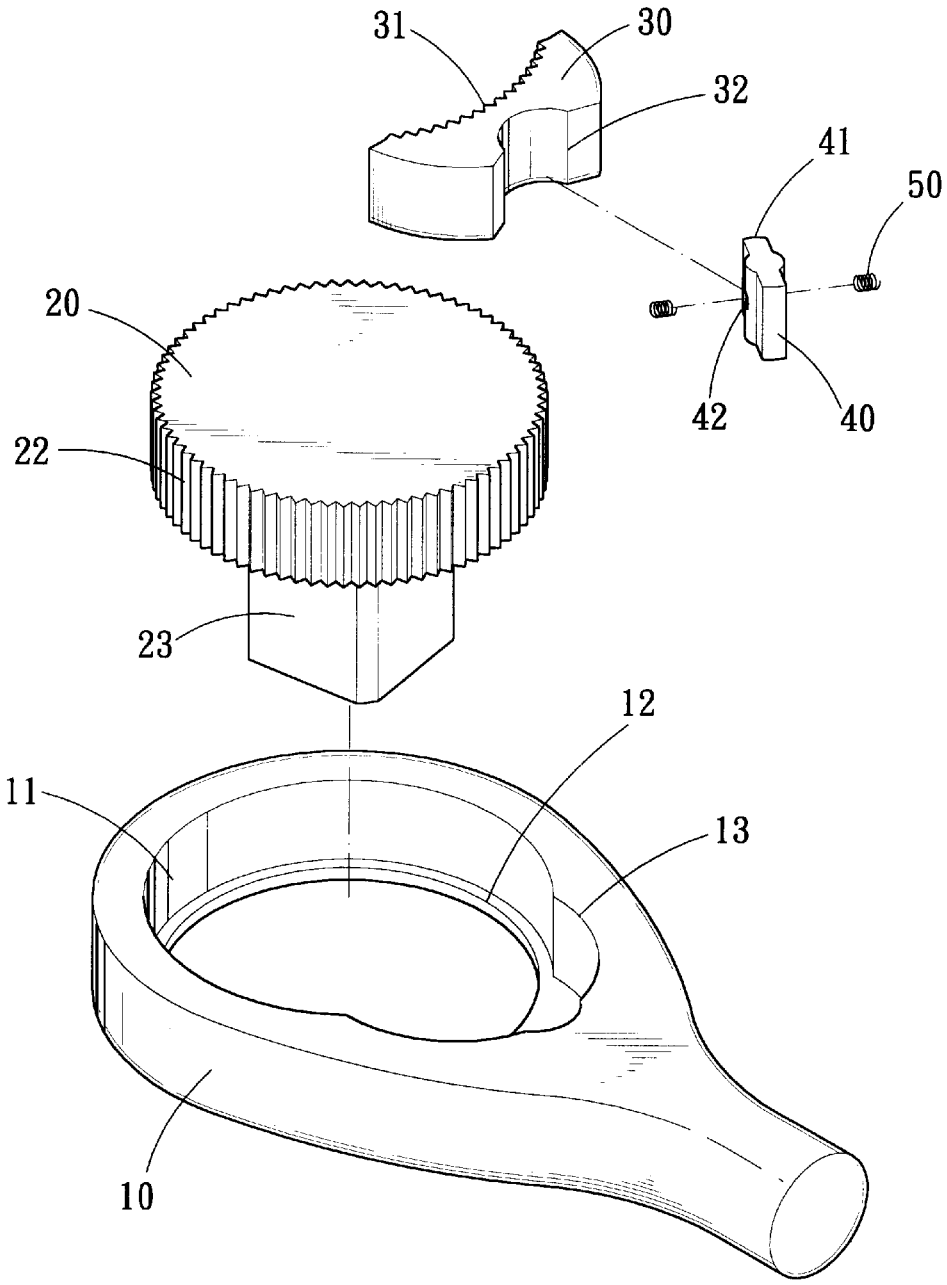
FIG. 6 is an exploded perspective view of a ratchet wrench structure in accordance with a second embodiment of the present invention.

Referring to FIG. 6, in accordance with a second embodiment of the present invention, the ratchet wheel 20 has a center formed with a fitting end 23 that can be fitted with a socket (not shown).

Figure 7:
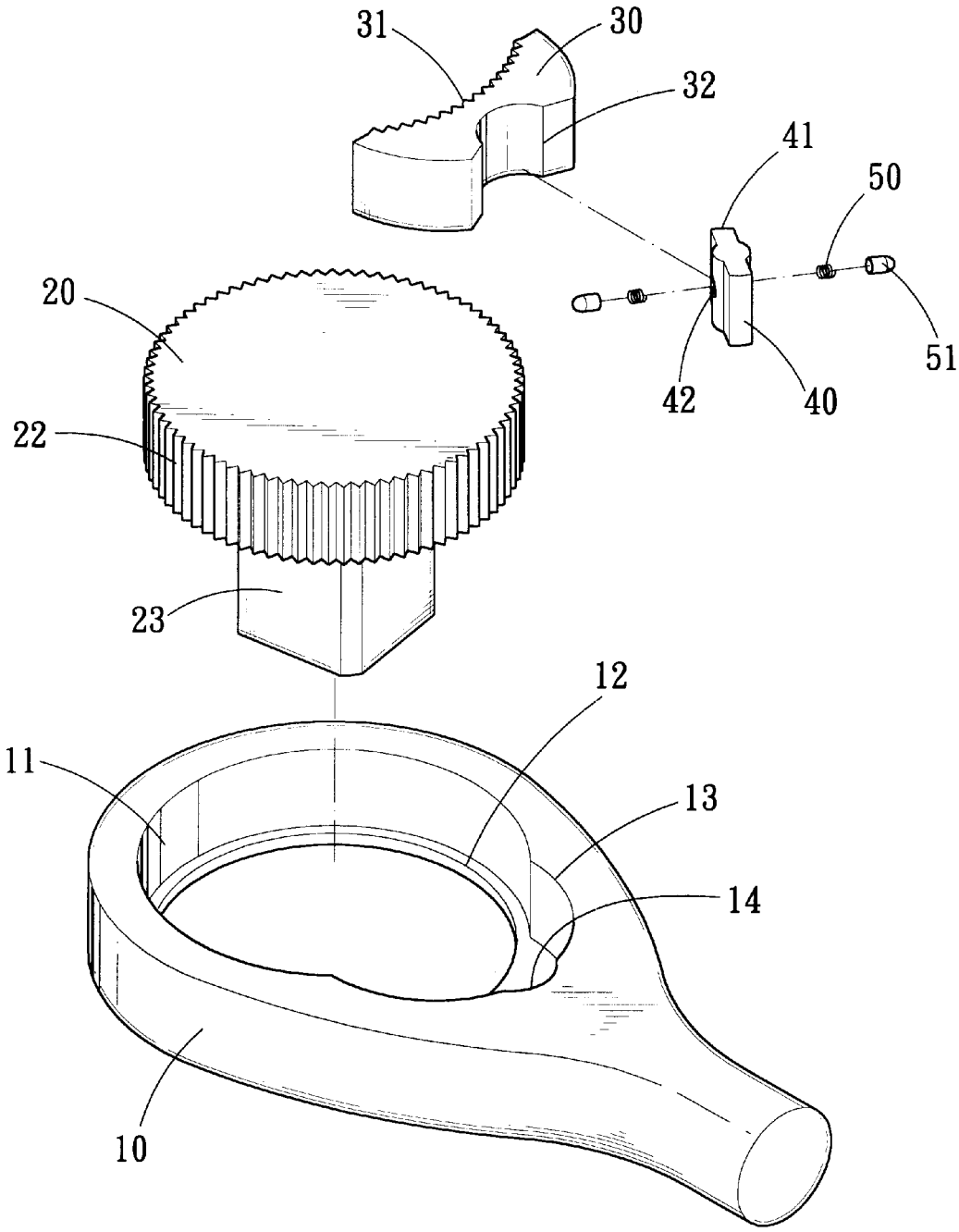
FIG. 7 is an exploded perspective view of a ratchet wrench structure in accordance with a third embodiment of the present invention.

Referring to FIG. 7, in accordance with a third embodiment of the present invention, a cap 51 is mounted on the front end of each elastic member 50, so that the elastic member 50 may smoothly contact the arcuate inner face 32 of the locking pawl 30 or the arcuate resting face 14 of the receiving recess 13.

Figure 8:
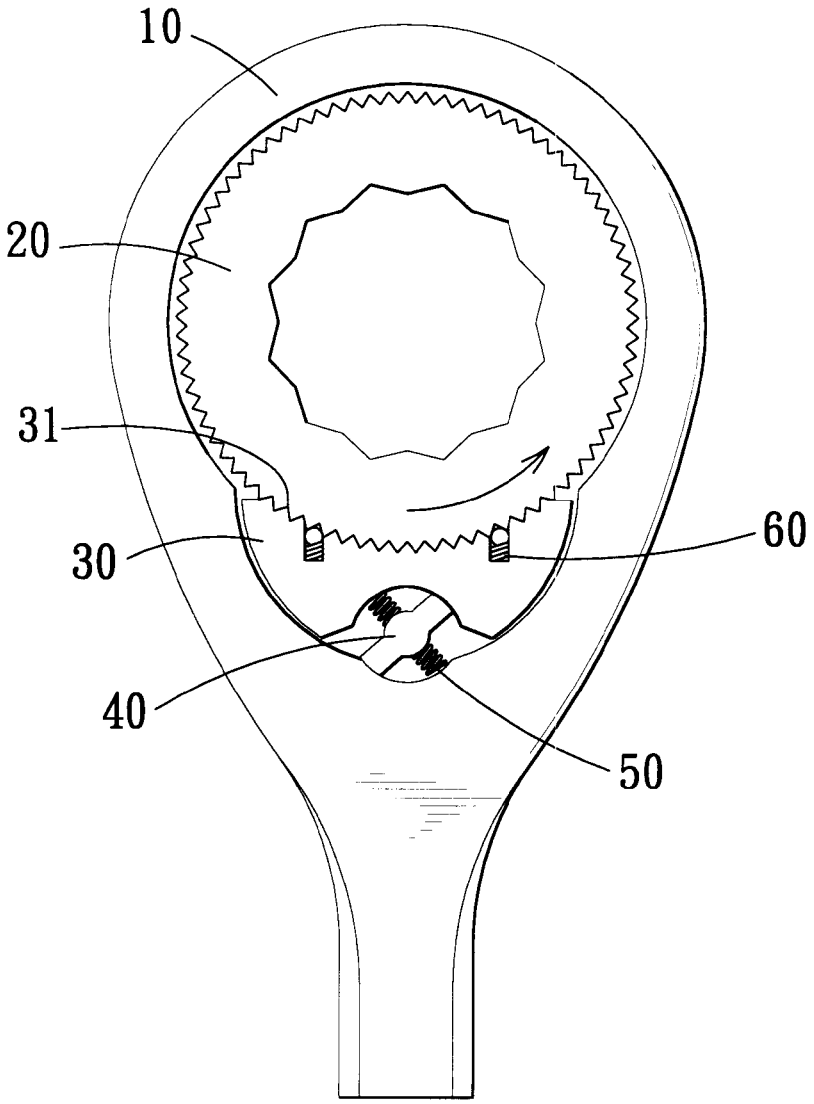
FIG. 8 is a top plan view of a ratchet wrench structure in accordance with a fourth embodiment of the present invention.

Referring to FIG. 8, in accordance with a fourth embodiment of the present invention, two elastomers 60 are mounted in the end face of the locking teeth 31 of the locking pawl 30.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench structure, comprising:

a wrench body having a drive head defining a receiving hole for receiving a ratchet wheel, the receiving hole having one side defining a receiving recess for receiving a locking pawl, a resting block, and two elastic members, the receiving recess being formed with an arcuate resting face so that one end of the resting block is rested on the arcuate resting face of the receiving recess;

the ratchet wheel having an outer periphery provided with engaging teeth;

the locking pawl being substantially semi-arc-shaped, and having a first side formed with locking teeth capable of engaging the engaging teeth of the ratchet wheel, and a second side formed with an arcuate inner face;

the resting block substantially having an elongated shape, and having a first end rested on the arcuate resting face of the receiving recess, and a second end formed with a resting end rested on the arcuate inner face of the locking pawl; and the two elastic members being received in two sides of the resting block, the resting block and the two elastic members being arranged to form a substantially X-shaped combination, so that a first elastic member is rested on the arcuate resting face of the receiving recess, and a second elastic member is rested on the arcuate inner face of the locking pawl.

2. The ratchet wrench structure in accordance with claim 1, wherein the receiving hole has a bottom end formed with an annular locking flange.

3. The ratchet wrench structure in accordance with claim 1, wherein the ratchet wheel has a center formed with a polygonal recess.

4. The ratchet wrench structure in accordance with claim 1, wherein the resting block has two sides each formed with a receiving space for receiving each of the two elastic members.

5. The ratchet wrench structure in accordance with claim 1, wherein each elastic member has a front end fitted with a cap.

* * * * *